United States Patent [19]

Luchsinger et al.

[11] 4,050,387

[45] Sept. 27, 1977

[54] FLUID INDUSTRIAL WASTE INCINERATOR AND ITS METHOD OF OPERATION

[75] Inventors: Peter Luchsinger, Zurich, Switzerland; Heribert Muckenheim, Offenbach, Germany; Hanns-Helmut Riemann, Bochum-Querenburg, Germany; Hans Sonnenschein; Erich Michel, both of Essen, Germany

[73] Assignees: Von Roll AG, Switzerland; Gelsenberg Mannesmann Umweltschutz GmbH, Germany

[21] Appl. No.: 667,592

[22] Filed: Mar. 17, 1976

[30] Foreign Application Priority Data

Mar. 18, 1975 Switzerland ..... 3434/75

[51] Int. Cl.[2] ..... F23G 5/12; F22B 33/00

[52] U.S. Cl. ..... 110/8 A; 110/8 C; 110/10; 122/2

[58] Field of Search ..... 110/7 R, 8 A, 8 C, 10; 122/2

[56] References Cited

U.S. PATENT DOCUMENTS

| | | | |
|---|---|---|---|
| 1,973,697 | 9/1934 | Bailey | 110/10 |
| 3,223,074 | 12/1965 | Tanner et al. | 122/2 |
| 3,457,883 | 7/1969 | Ankersen | 110/10 |
| 3,559,597 | 2/1971 | Heiny | 110/10 |

FOREIGN PATENT DOCUMENTS

| | | | |
|---|---|---|---|
| 1,289,938 | 2/1969 | Germany | 110/10 |

*Primary Examiner*—Kenneth W. Sprague
*Attorney, Agent, or Firm*—Weingarten, Maxham & Schurgin

[57] ABSTRACT

A liquid bath furnace, for burning pumpable wastes comprising hydrocarbon compounds and mineral substances, has primary and secondary combustion chambers, the walls of which are provided with La Mont boiler heating surfaces, and a post-combustion chamber. The heating surfaces are provided with heat-conducting cladding. In operation of the furnace, the wastes are fed to the primary combustion chamber, where the hydrocarbons dissociate and the mineral substances melt, a layer of the latter solidifying on the cladding in this chamber. An oil burner is used to regulate the primary combustion chamber temperature.

12 Claims, 1 Drawing Figure

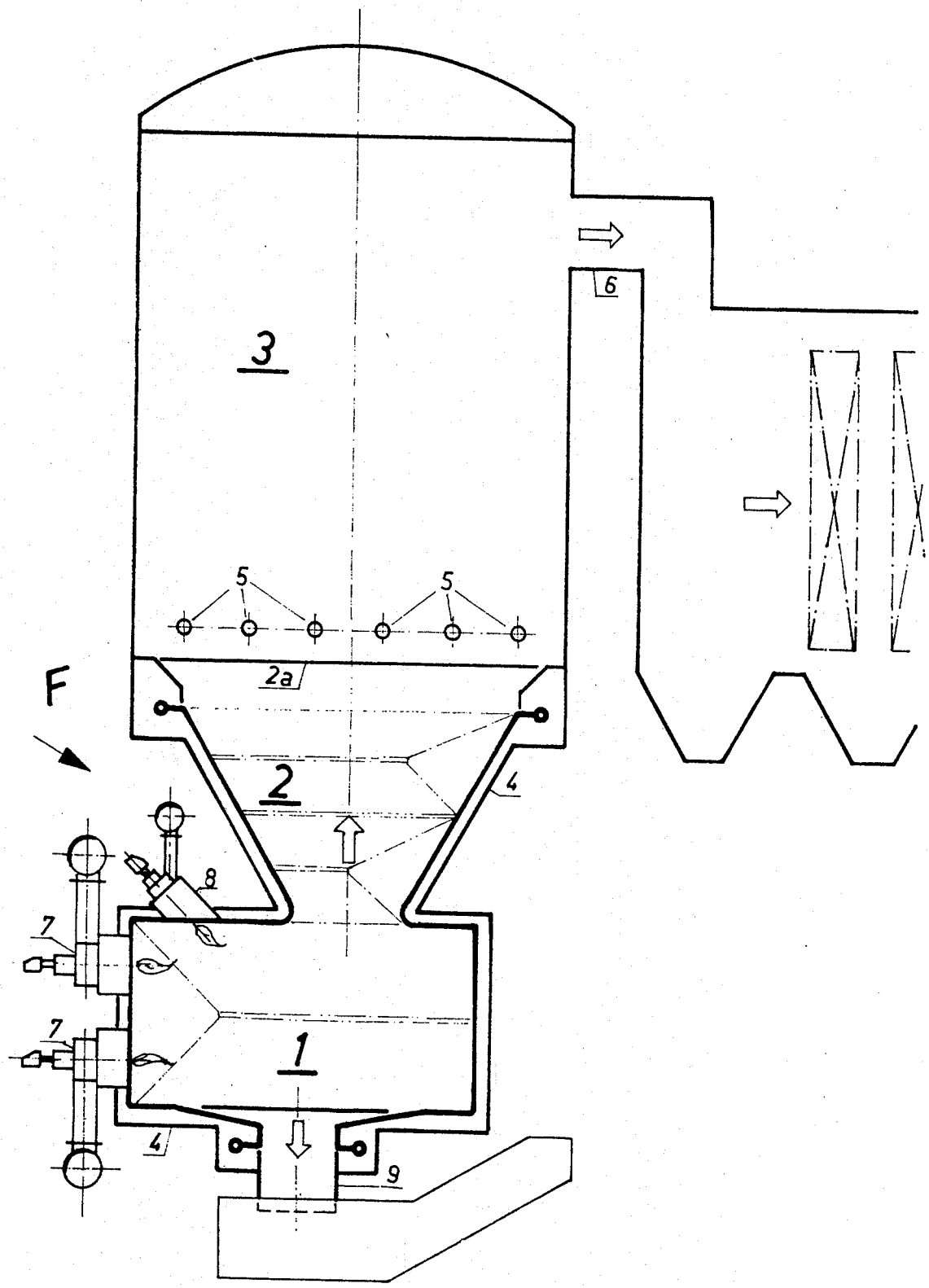
3
6
5
5
2a
F
2
4
8
7
7
1
4
9

FLUID INDUSTRIAL WASTE INCINERATOR AND ITS METHOD OF OPERATION

BACKGROUND OF THE INVENTION

1. Field of the Invention

This invention relates to a furnace for burning a fluent waste comprised of organic compound and mineral substance, in particular pumpable industrial wastes, and to a combustion method thereof.

2. Description of the Prior Art

There are already known various furnaces for the burning of pumpable industrial wastes, consisting of hydrocarbon compounds mixed with mineral substances, and various methods of operating such furnaces.

On the other hand, liquid bath furnaces are known for the burning of solid fuels such as hard coal, lignite and pulverised coal (see R. Günther, "Burning and Firing Systems", Springer-Verlag, Berlin, Heidelberg, New York, 1974, pp.308–311), and it is also known in liquid bath furnaces to provide a primary chamber and a secondary chamber, and to cool the primary chamber bottom by heating surface elements of a La Mont boiler (Münzinger, "Steam Power", Springerverlag, Berlin, Gottingen, Heidelberg, 3rd Ed., 1949 pp. 334–35).

Because the required standards of environmental protection are being continually raised, the economical, complete and yet practicable destruction and elimination of industrial wastes consisting of hydrocarbon compounds mixed with mineral substances currently presents a problem which has heretofore not been properly solved. More especially the unsatisfactory combustion process and ash discharge, and also the high rate of wear on masonry and on wall cooling tubes of the combustion chamber walls have constituted extremely difficult problems in the burning of such industrial wastes.

SUMMARY OF THE INVENTION

According to one of its aspects the present invention provides a liquid bath furnace for the combustion of a fluent waste comprised of organic compound and mineral substance, comprising a primary combustion chamber for the combustion of said waste and containing a hot liquid bath, a secondary combustion chamber connected downstream of said primary combustion chamber for gaseous products from said primary combustion chamber, a post-combustion chamber connected downstream of said secondary combustion chamber for gaseous products from said secondary combustion chamber, forced-flow boiler heating surface portions of said primary combustion chamber, and heat-conducting cladding on said surface portions.

According to another of its aspects the present invention provides a combustion method, comprising supplying to a combustion chamber of a liquid bath furnace a fluent waste comprised of organic compound and mineral substance, combusting the waste in the combustion chamber at a temperature high enough to produce dissociation of said organic compound and melting of said mineral substance, forming a liquid bath comprised of the molten mineral substance, and maintaining at a temperature below the melting temperature of said mineral substance heat-transfer surface portions of said combustion chamber so that on said surface portions there is a protective layer of solidified molten mineral substance.

According to a further of its aspects the present invention provides a combustion method, comprising supplying to a primary combustion chamber of a liquid bath furnace a fluent waste comprised of organic compound and mineral substance, combusting the waste in the primary combustion chamber at a temperature of up to 1800° so that said organic compound is at least partly dissociated into its constituents and oxidized, and said mineral substance is melted, maintaining inner heat-transfer surface portions of heat-conducting cladding on forced-flow boiler heating surface portions of said primary combustion chamber at a temperature below the melting temperature of said mineral substance so that on said inner heat-transfer surface portions there is a protective layer of solidified molten mineral substance, and passing gaseous products from said primary combustion chamber to a secondary combustion chamber, the thickness of said protective layer varying automatically in time.

BRIEF DESCRIPTION OF THE DRAWING

The drawing shows diagrammatically, in vertical section, a liquid bath furnace.

DESCRIPTION OF THE PREFERRED EMBODIMENT

A liquid bath furnace given the general reference numeral F comprises a primary combustion chamber 1, a secondary combustion chamber 2 and a post-combustion chamber 3 situated downstream of the secondary chamber 2. The walls 4 of the primary chamber 1 and the secondary chamber 2 are provided with La Mont boiler heating surfaces for discharging the heat evolved in the burning process, these heating surfaces being arranged as wall cooling tubes and being clad, and thereby protected, with a corrosion-inhibiting, commerically conventional ramming mass which has good heat-conducting properties, as shown in the drawing by thickly drawn lines for the combustion chamber walls 4. The post-combustion chamber 3 is provided, a short distance downstream of a gas outlet 2*a* from the secondary chamber 2, with a series of inlet apertures 5 for secondary air. The burned-out, calmed combustion gases issue from the post-combustion chamber 3 by way of an outlet aperture 6 and act on heating surfaces of a waste heat boiler (not shown).

Burners 7 are used for feeding-in pumpable industrial wastes into the primary chamber 1, whilst at least one burner 8 directed obliquely downwards into the primary chamber 1 is fed with fuel oil or waste oil during starting and also, for the purpose of regulating the temperature in the primary chamber 1, when the furnace is in operation. The primary chamber 1 comprises an outlet aperture 9 by way of which molten combustion residues of the burned industrial waste material can be discharged.

The industrial wastes to be burned in the liquid bath furnace F consist of hydrocarbon compounds mixed with inert mineral substances, e.g. halogen-containing organic hydrocarbons or mixtures of such compounds, and the mineral substances forming part of the composition thereof have melting points in the temperature range from 500° to 1250° C. The burning process in the liquid bath furnace F is so regulated that in the primary chamber 1 there prevails a temperature in the range 1400°–1800° C, at the outlet of the secondary chamber 2 a temperature between 1100° and 1200° C, and in the post-combustion chamber 3 a temperature of 900° C plus or minus 50° C. By selecting the temperature in the primary chamber 1 to be between 1400° and 1800° C, on the one hand the condition is met that even the thermally most stable halogenated hydrocarbon compounds are dissociated into their constitutents, such as HCl, HF, $CO_2$, $H_2O$, etc., and oxydised, and on the other hand the conditions are also provided for melting the mineral substances contained in the industrial wastes, so that these substances can be discharged in the molten state by way of the outlet aperture 9.

The wall cooling tubes arranged at the walls 4 of the primary chamber 1 are so protected by the rammed layer arranged thereon that the surface thereof will in all cases be at a temperature below the melting point of the mineral fractions of the liquid industrial wastes. On this rammed layer, therefore, there builds up a protective layer consisting of some of the molten mineral constituents which has solidified, the thickness of this protective layer adapting itself automtically to the variable melting point of the varying mineral proportion of the industrial wastes, and to the combustion chamber temperature prevailing at the time in the primary chamber 1, but never diminishing to zero, since the rammed layer situated behind generally has in fact substantially lower temperatures than the melting point of the molten mineral fraction. Thus the furnace itself regulates the formation of an adequate protective layer, increasing or decreasing in thickness on the rammed layer surface at the liquid bath side depending on the temperature conditions in the primary chamber 1. It is possible to ensure thereby that the rammed layer does not exceed a temperature of 400° C at its liquid bath side, thus quaranteeing adequate physical protection for the ramming mass. Under these conditions, it is possible to have a steam temperature below 400° C in the La Mont system.

Normally no melting takes place in the secondary chamber 2, but a proportion of the hydrocarbons may be burned in the secondary chamber.

Instead of providing the La Mont heating surfaces of both combustion chambers 1 and 2 with a ramming mass cladding, it would also be possible to clad the wall cooling tubes only in the primary chamber 1 with a rammed layer for inhibiting corrosion and giving good heat-conducting properties. Instead of La Mont elements, heating surfaces of another forced-circulation boiler could be used, and instead of heating surfaces of a forced-circulation boiler, heating surfaces of a forced-flow once-through boiler may be used, both of these boilers being of the so-called "forced-flow" type. The geometric shape of the three chambers 1, 2 and 3 of the liquid bath furnace F can be optionally chosen, i.e. round, for example cylindrical or conical, or even of a prismatic angular form.

Combustible solids may also be contained in the pumpable industrial wastes.

We claim:

1. A liquid bath furnace for the combustion of pumpable, fluent waste comprised of organic compound and mineral substance, said furnace comprising:

a primary hot liquid bath combustion chamber for the combustion of said waste;

wall-cooling tubes disposed on the inside surface of said chamber;

a corrosive-inhibiting, heat conductive ramming mass cladded to said wall-cooling tubes to thereby provide an inner chamber surface within said primary combustion chamber that is maintainable at a temperature below the melting temperature of said mineral substance in said waste;

a secondary combustion chamber connected downstream of said primary combustion chamber for the combustion of gaseous products from said primary combustion chamber; and a post-combustion chamber connected downstream of said secondary combustion chamber for the combustion of gaseous products from said secondary combustion chamber.

2. A furnace according to claim 1, wherein said post-combustion chamber comprises inlet means for secondary air supply.

3. A furnace according to claim 1, and further comprising, downstream of said post-combustion chamber, waste-heat boiler heating surface portions.

4. A furnace according to claim 1, wherein said primary combustion chamber is provided with a burner for regulating the temperature in said primary combustion chamber.

5. A furnace according to claim 1 wherein said secondary combustion chamber comprises:

wall-cooling tubes disposed on the inside surface of said secondary combustion chamber;

a corrosive-inhibiting, heat conductive ramming mass cladding said wall-cooling tubes to thereby provide an inner chamber surface within said secondary combustion chamber that is maintainable at a temperature below the melting temperature of said mineral substance in said waste.

6. A furnace according to claim 1 wherein said wall-cooling tubes are a part of a forced flow boiler heating system.

7. A furnace according to claim 1 wherein said wall-cooling tubes are part of a forced circulation boiler heating system.

8. A method of incinerating pumpable, fluent waste comprised of organic compound and mineral substance, said method comprising the steps of:

introducing said waste into a primary combustion chamber of a liquid bath furnace;

combusting the waste in said primary combustion chamber at a temperature sufficient to produce dissociation of said organic compound and melting of said mineral substance;

maintaining the temperature of the inside surface of said primary combustion chamber at a temperature below the melting temperature of said mineral substance to allow the forming of a layer of solidified mineral substance on said inside surface.

9. A combustion method according to claim 8 comprising the further steps of:

passing gaseous products from said primary combustion chamber to a secondary combustion chamber;

combusting said gaseous products in said secondary combustion chamber; and maintaining the temperature of the inside surface of said secondary combustion chamber at a temperature below the melting temperature of said mineral substance to allow the forming of a layer of solidified mineral substance on said inside surface of said secondary combustion chamber.

10. A method according to claim 9, wherein gaseous products are passed from said secondary combustion chamber to a post-combustion chamber.

11. A method according to claim 10, wherein at the outlet of said post-combustion chamber a temperature of 900° C plus or minus 50° C is maintained.

12. A method according to claim 10, wherein secondary air is fed into said post-combustion chamber.

* * * * *